US009211702B2

(12) United States Patent
Otokita

(10) Patent No.: US 9,211,702 B2
(45) Date of Patent: Dec. 15, 2015

(54) LIQUID EJECTING APPARATUS

(71) Applicant: SEIKO EPSON CORPORATION, Tokyo (JP)

(72) Inventor: Kenji Otokita, Nagano (JP)

(73) Assignee: Seiko Epson Corporation, Tokyo (JP)

( * ) Notice: Subject to any disclaimer, the term of this patent is extended or adjusted under 35 U.S.C. 154(b) by 0 days.

(21) Appl. No.: 14/575,732

(22) Filed: Dec. 18, 2014

(65) Prior Publication Data

US 2015/0174899 A1 Jun. 25, 2015

(30) Foreign Application Priority Data

Dec. 24, 2013 (JP) ..... 2013-265197

(51) Int. Cl.
*B41J 29/38* (2006.01)
*B41J 2/045* (2006.01)

(52) U.S. Cl.
CPC ..... *B41J 2/04588* (2013.01); *B41J 2/04581* (2013.01)

(58) Field of Classification Search
USPC ..... 347/5, 9, 10–11
See application file for complete search history.

(56) References Cited

U.S. PATENT DOCUMENTS

2002/0012017 A1* 1/2002 Yonekubo ..... 347/10
2004/0207671 A1* 10/2004 Kusunoki et al. ..... 347/10

FOREIGN PATENT DOCUMENTS

JP 2010-264689 11/2010

* cited by examiner

*Primary Examiner* — Lam Nguyen
(74) *Attorney, Agent, or Firm* — Workman Nydegger

(57) ABSTRACT

It is possible to generate an ejection driving pulse which ejects ink, and a plurality of minute vibration driving pulses which cause a pressure fluctuation in ink in a pressurizing chamber to an extent of not causing the ink to be ejected; the ejection driving pulse includes a first expansion element which causes the pressurizing chamber to be expanded by being changed from a reference potential to a first potential which is lower than the reference potential, and a first contraction element which causes the pressurizing chamber to be contracted by being changed from the first potential to the reference potential; and the minute vibration driving pulse includes a second contraction element which causes the pressurizing chamber to be contracted by being changed from a second potential which is lower than the reference potential to a third potential which is higher than the second potential and the first potential, and is lower than the reference potential, and a second expansion element which causes the pressurizing chamber to be expanded by being changed from the third potential to the second potential.

4 Claims, 7 Drawing Sheets

| VOLTAGE (V) | TIME (μs) | SLOPE (V/μs) |
|---|---|---|
| 9 | 3 | 3.0 |
| 15 | 5 | 3.0 |
| 20 | 7 | 2.9 |
| 26 | 9 | 2.9 |
| 35 | 11 | 3.2 |

LIQUID EJECTING APPARATUS

The entire disclosure of Japanese Patent Application No: 2013-265197, filed Dec. 24, 2013 is expressly incorporated by reference herein in its entirety.

BACKGROUND

1. Technical Field

The present invention relates to a liquid ejecting apparatus such as an ink jet recording apparatus, and in particular relates to a liquid ejecting apparatus which includes a liquid ejecting head which ejects liquid from a nozzle by causing a pressure fluctuation in the liquid in a pressurizing chamber by driving a pressure generator, the pressure generator being driven by applying a driving waveform to the pressure generator.

2. Related Art

A liquid ejecting apparatus is an apparatus which includes a liquid ejecting head, and ejects (discharges) various types of liquid from the liquid ejecting head. As examples of the liquid ejecting apparatus, there is an image recording apparatus such as an ink jet printer, or an ink jet plotter. However, in recent years, the liquid ejecting apparatus is also applied to various manufacturing apparatuses by utilizing an advantage of accurate landing of liquid of an extremely small amount in a predetermined position. For example, the liquid ejecting apparatus can be applied to a display manufacturing apparatus which manufactures a color filter such as a liquid crystal display, an electrode forming apparatus which forms an electrode of an organic electro luminescence (EL) or a field emission display (FED), and a chip manufacturing apparatus which manufactures a biochip. In addition, liquid ink is ejected from a recording head for the image recording apparatus, and a solution of each color material of red (R), green (G), and blue (B) is ejected from a color material ejecting head for the display manufacturing apparatus. In addition, a liquid electrode material is ejected from an electrode material ejecting head for the electrode forming apparatus, and a solution of a bio organic matter is ejected from the living body organic matter ejecting head for the chip manufacturing apparatus.

Here, the above described liquid ejecting head causes a pressure fluctuation in liquid in a pressurizing chamber which communicates with a nozzle by driving a pressure generator, and causes the liquid to be ejected from the nozzle using the pressure fluctuation. In addition, as the pressure generator, a piezoelectric element which is deformed when a driving signal (driving voltage) is supplied is preferably used. In addition, as the driving signal which ejects liquid, a so-called ejection driving pulse with a trapezoidal wave (driving voltage waveform) is used since it is possible to eject liquid with high precision. The trapezoidal wave includes an expansion element which causes the pressurizing chamber to expand by being changed from a reference potential to an expansion potential which is lower than the reference potential, and a contraction element which causes the pressurizing chamber to be contracted by being changed from the expansion potential to the reference potential are used. In addition to the ejection driving pulse, a minute vibration driving pulse is included as part of the driving signal. The minute vibration driving pulse causes liquid in the pressurizing chamber to be vibrated (so-called minute vibration operation) to the extent that liquid is not caused to be ejected, in order to reduce thickening of a meniscus in a nozzle in which liquid is not ejected (for example, refer to JP-A-2010-264689). In the minute vibration driving pulse, a trapezoidal wave is used in which a voltage change from the reference potential is smaller than that of the ejection driving pulse. When such a minute vibration driving pulse is applied to a piezoelectric element, the piezoelectric element is heated, liquid in the pressurizing chamber is heated, and the liquid in the pressurizing chamber is agitated. The minute vibration driving using such a minute vibration driving pulse is performed with respect to a nozzle (in which ejection of liquid is not performed in the middle of liquid ejection processing) so that a variation in ejection property (amount, flying speed, or the like of ejected liquid) between an oft-used nozzle in which ejection of liquid is performed a relatively large number of times, and thickening of the nozzle is suppressed due to heating of the piezoelectric element and a less-used nozzle in which ejection of liquid is performed a relatively small number of times, and thickening of the nozzle in progress is suppressed.

Meanwhile, it is known that displacement amount (amount of deformation) of the piezoelectric element with respect to an applied driving voltage has a non-linear property (specifically, a hysteresis property). For example, in a piezoelectric property of a piezoelectric element which is exemplified in FIG. 5, a non-linear region in which a ratio of the displacement amount to the driving voltage is small is present on both vertical sides (low voltage side and high voltage side) of the linear region in which the ratio of the displacement amount to the driving voltage is large. For this reason, when liquid to be reliably ejected using a trapezoidal wave which is the driving voltage waveform, and a pressure fluctuation in the pressurizing chamber is desired to be as large as possible, a reference potential of the trapezoidal wave is set to a potential corresponding to the non-linear region on the high voltage side, and an expansion potential is set to a potential corresponding to the non-linear region on the low voltage side. It is possible to make the displacement amount of the piezoelectric element large by including the linear region in a voltage changing area of the driving voltage in this manner, and for example, it is possible to eject liquid of high viscosity (such as UV ink which is cured when being irradiated with a UV ray (light) with high precision).

However, when the reference potential is set to be high in order to make the displacement amount of the piezoelectric element large, there is a concern that it may not be possible to sufficiently reduce (suppress) thickening using a minute vibration operation. Specifically, since an amount of change in voltage of the minute vibration driving pulse is smaller than that of the ejection driving pulse, it is not possible to sufficiently use the linear region when the reference potential becomes high, and the displacement amount due to the piezoelectric element is not sufficient. That is, the higher the reference potential, the greater the ratio of the non-linear region to the voltage changing area of the minute vibration driving pulse, and the smaller the displacement amount of the piezoelectric element. Due to this, it is not possible to sufficiently agitate liquid in the pressurizing chamber, and to sufficiently heat liquid in the pressurizing chamber, since an amount of heat using the piezoelectric element decreases. As a result, viscosity of liquid becomes different between a nozzle in which ejection of liquid is performed relatively many times and a nozzle in which ejection of liquid is performed relatively few times, and a variation occurs in ejection properties such as an amount, or a flying speed of liquid ejected from a nozzle. In particular, since a ratio of viscosity of UV ink which is changed due to a change in temperature is large compared to normal ink, the variation in the above described ejection property becomes significant.

SUMMARY

An advantage of some aspects of the invention is to provide a liquid ejecting apparatus which can uniformize ejection properties in each nozzle by reducing a difference in temperature between nozzles.

According to an aspect of the invention, there is provided a liquid ejecting apparatus which includes a liquid ejecting head which causes a pressure fluctuation in liquid in a pressurizing chamber by driving a pressure generator, and ejects the liquid from a nozzle which communicates with the pressurizing chamber using the pressure fluctuation, in which it is possible to generate a first driving waveform in which liquid is ejected from the nozzle by driving the pressure generator, and a plurality of second driving waveforms which cause a pressure fluctuation in liquid in the pressurizing chamber to an extent of not causing liquid to be ejected from the nozzle, the first driving waveform includes a first expansion element which causes the pressurizing chamber to be expanded by being changed from a reference potential which is a reference of a change in potential to a first potential which is lower than the reference potential, and a first contraction element which causes the pressurizing chamber to be contracted by being changed from the first potential to the reference potential, and the second driving waveform includes a second contraction element which contracts the pressurizing chamber by being changed from a second potential which is lower than the reference potential to a third potential which is higher than the second potential and the first potential, and is lower than the reference potential, and a second expansion element which causes the pressurizing chamber to be expanded by being changed from the third potential to the second potential.

In the liquid ejecting apparatus, a second driving waveform group which is formed of a plurality of sets of the second driving waveform may be generated, and a front side changing element which causes a change from the reference potential to the second potential may be generated before the second driving waveform group.

In the liquid ejecting apparatus, a rear side changing element which causes a change from the second potential to the reference potential may be generated after the second driving waveform group.

In the liquid ejecting apparatus, the liquid may be photocurable liquid which is cured when being irradiated with light.

According to the aspect of the invention, since a voltage of the second driving waveform is changed between the second potential which is lower than the reference potential and a third potential which is higher than the first and second potentials, and is lower than the reference potential, it is possible to drive a piezoelectric element in a region in which displacement amount (amount of deformation) in a piezoelectric property of the piezoelectric element (piezoelectric substance) which is a type of a pressure generator is large. In this manner, it is possible to raise an amount of heat using the piezoelectric element when causing liquid in the pressurizing chamber corresponding to a nozzle in which liquid is not ejected to be minutely vibrated. As a result, it is possible to reduce a difference in temperature of liquid between a nozzle in which liquid is ejected and a nozzle in which liquid is not ejected, and to suppress a variation in ejection properties of liquid between nozzles. In addition, since it is possible to raise a heat amount using the piezoelectric element in a maintenance operation (minute vibration operation which causes liquid in pressurizing chamber to be minutely vibrated) which is performed between printing operations, an effect of suppressing thickening of liquid can be raised. As a result, it is possible to make a time for the maintenance operation short. In particular, it is hard for photocurable liquid such as UV ink to be thickened due to volatilization compared to normal ink; however, a ratio of viscosity which is changed due to a change in temperature is large instead, and a decrease in viscosity due to heat of the piezoelectric element becomes remarkable, compared to an increase in viscosity due to a short maintenance operation time. As a result, it is possible to make a time for minute vibration operation in a liquid ejecting apparatus in which photocurable liquid is used shorter. In addition, since the second driving waveform drives the piezoelectric element between the second potential and the third potential which are lower than the reference potential, it is possible to suppress displacement amount of the piezoelectric element compared to the first driving waveform. In this manner, it is possible to suppress bending of a partitioning wall due to a generation of tension in the partitioning wall which partitions neighboring pressurizing chambers, and to suppress a change in ejection property due to this, that is, so-called crosstalk.

BRIEF DESCRIPTION OF THE DRAWINGS

The invention will be described with reference to the accompanying drawings, wherein like numbers reference like elements.

DESCRIPTION OF EXEMPLARY EMBODIMENTS

Hereinafter, an embodiment of the invention will be described with reference to accompanying drawings. In addition, the embodiment which will be described below is variously limited as a preferable specific example of the invention. However, the scope of the invention is not limited to these aspects as long as there is no description of limiting the invention, particularly, in the description below. In addition, hereinbelow, an ink jet recording apparatus (hereinafter, referred to as printer) will be described as an example, as a liquid ejecting apparatus of the invention.

Figure 1:
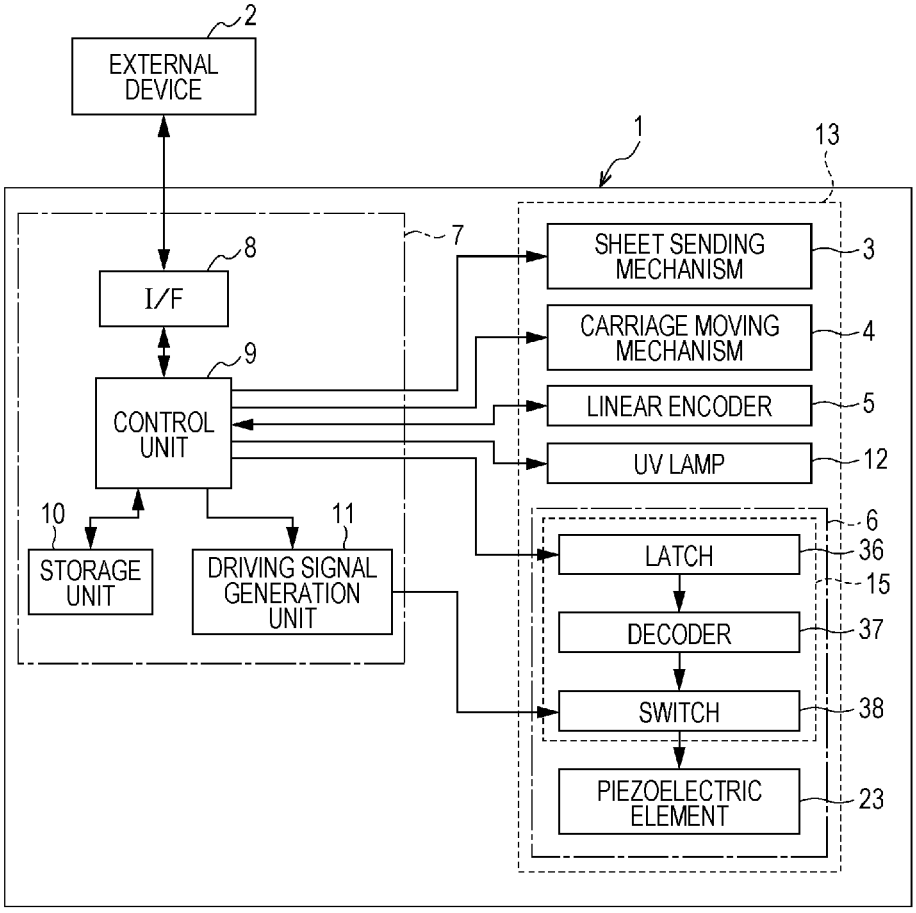
FIG. 1 is a block diagram used to describe an electric configuration of a printer.
Figure 2:
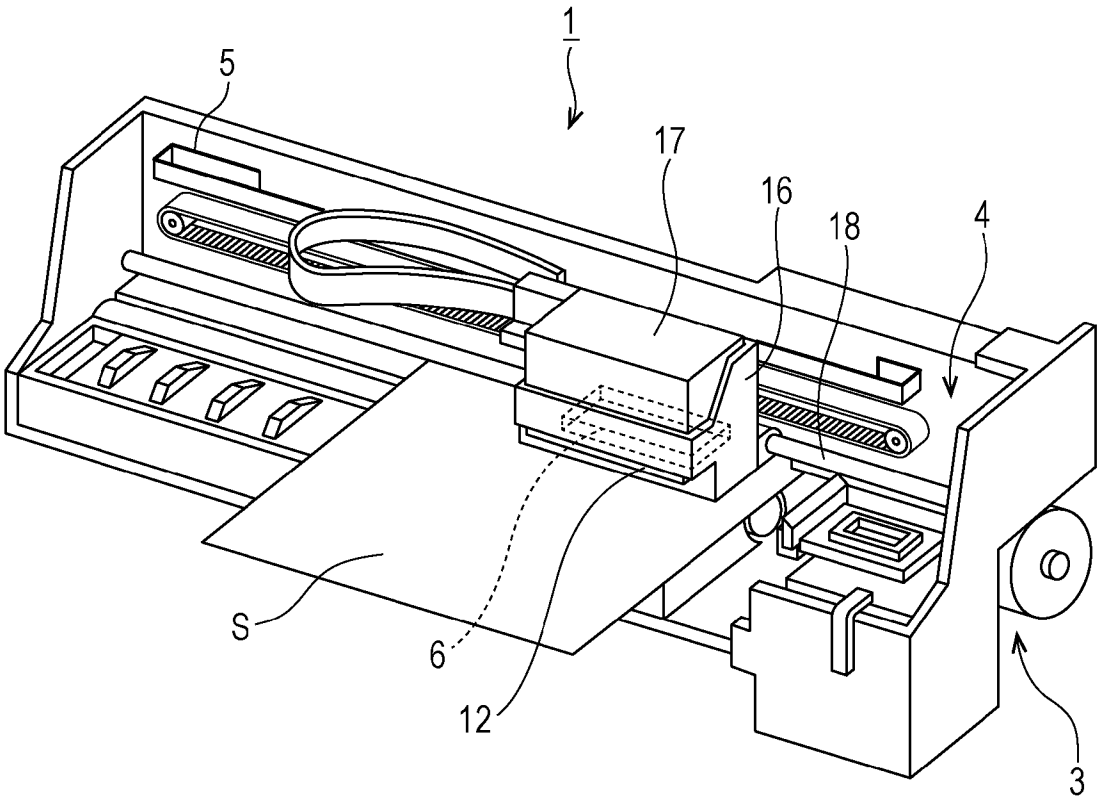
FIG. 2 is a perspective view of an internal configuration of the printer.

FIG. 1 is a block diagram which illustrates an electric configuration of a printer 1. FIG. 2 is a perspective view of an internal configuration of the printer 1. An external device 2 is an electronic device such as a computer, a digital camera, a mobile phone, and a mobile information terminal, for example. The external device 2 is electrically connected to the printer 1 in a wireless or wired manner, and transmits print data corresponding to an image, or the like, to the printer 1, in order to print an image or text on a recording medium S such as a recording sheet in the printer 1.

The printer 1 in the embodiment includes a print engine 13 such as a sheet sending mechanism 3, a carriage moving mechanism 4, a linear encoder 5, a recording head 6, and a printer controller 7. The recording head 6 is attached to a base side of a carriage 16 which is mounted with an ink cartridge 17 (liquid supply source). In addition, the carriage 16 is configured so as to reciprocate along a guide rod 18 using the carriage moving mechanism 4. That is, the printer 1 records an image, or the like, by causing ink to land on a recording medium S by sequentially transporting the recording medium S (a type of landing target) such as a recording sheet using the sheet sending mechanism 3, and ejecting ink from a nozzle 25 (refer to FIG. 3) of the recording head 6 while relatively moving the recording head 6 in the width direction (in main scanning direction) of the recording medium S with respect to the recording medium. In addition, it is also possible to adopt a configuration in which the ink cartridge 17 is arranged on the main body side of the printer 1, and ink of the ink cartridge 17 is sent to the recording head 6 side through a supply tube.

As ink in the embodiment, UV ink (a type of photocurable liquid in the invention) is used, and which is cured when being irradiated with a UV ray (light). The UV ink is ink containing a photoinitiator, and is known as ink with high viscosity (for example, equal to or greater than 8 mPa·s at room temperature) compared to normal ink (for example, water-based ink). In addition, the UV ink is also known as ink which hardly volatizes, and of which a ratio of viscosity which is changed according to a change in temperature is large compared to normal ink. That is, low viscosity in the UV ink at a high temperature becomes remarkable compared to the normal ink. In addition, a UV lamp 12 which radiates a UV ray toward the recording medium S is attached, for example, to the base side of the carriage 16 (which is the downstream side of the recording head 6 in the transport direction of the recording medium S). In addition, the UV lamp radiates a UV ray while reciprocating with respect to the recording medium S which is sent to the downstream side. In this manner, ink which lands on the recording medium S is cured, and is fixed onto the recording medium S. In addition, it is also possible to adopt a configuration in which the UV lamp is arranged over a recording region on the downstream side of the recording medium S in the transport direction.

Figure 4A:
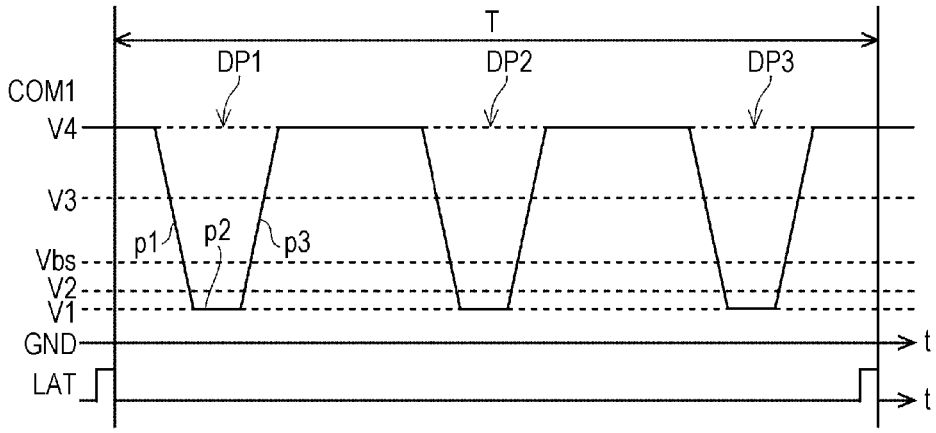
FIGS. 4A and 4B are waveform charts of a configuration of a driving signal.
Figure 4B:
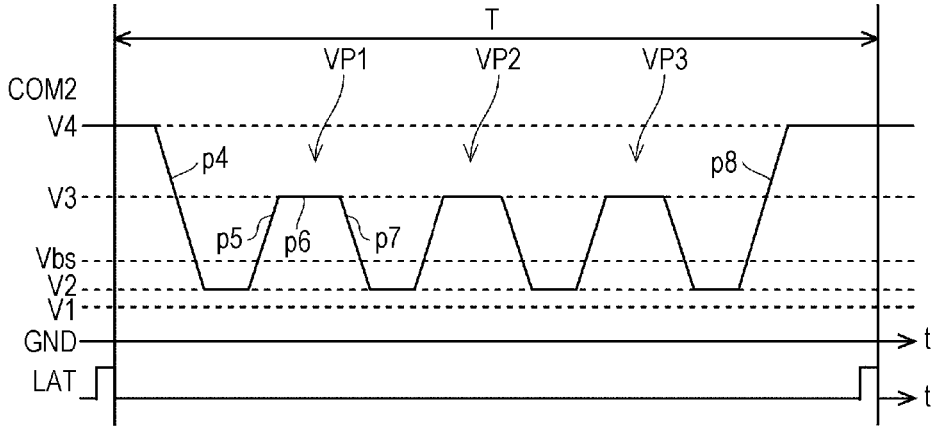

The printer controller 7 is a control unit which performs a control of each unit of the printer. The printer controller 7 according to the embodiment includes an interface (I/F) unit 8, a control unit 9, a storage unit 10, and a driving signal generation unit 11. The interface unit 8 performs transceiving of state data of the printer when sending print data or a printing command to the printer 1 from the external device 2, or outputting of state information of the printer 1 to the external device 2. The control unit 9 is an arithmetic processing unit for performing the entire control of the printer. The storage unit 10 is an element for storing data which is used in a program or various controls of the control unit 9, and includes a ROM, a RAM, and an NVRAM (non-volatile storage element). The control unit 9 controls each unit according to a program which is stored in the storage unit 10. In addition, the control unit 9 according to the embodiment generates ejection data which denotes at what timing, and from which nozzle 25 ink is ejected at a time of a recording operation, based on print data from the external device 2, and transmits the ejection data to a head control unit of the recording head 6. The driving signal generation unit 11 (a type of driving waveform generator) generates an analog signal based on waveform data related to a waveform of a driving signal, and generates a driving signal COM (COM1, COM2) as illustrated in FIGS. 4A and 4B by amplifying the signal.

Subsequently, the print engine 13 will be described. The print engine 13 includes the sheet sending mechanism 3, the carriage moving mechanism 4, the linear encoder 5, the UV lamp 12, the recording head 6, and the like, as illustrated in FIG. 1. The carriage moving mechanism 4 is configured of the carriage 16 to which the recording head 6 (as a type of a liquid ejecting head) is attached, and a driving motor (for example, DC motor) which causes the carriage 16 to move through a timing belt, or the like (not illustrated), and moves the recording head 6 which is mounted on the carriage 16 in the main scanning direction. The sheet sending mechanism 3 is formed of a sheet sending motor, a sheet sending roller, and the like, and performs sub-scanning by sequentially sending the recording medium S onto a platen. In addition, the linear encoder 5 outputs an encoder pulse corresponding to a scanning position of the recording head 6 which is mounted on the carriage 16 to the printer controller 7 as position information in the main scanning direction. The control unit 9 of the printer controller 7 can recognize a scanning position (current position) of the recording head 6 based on the encoder pulse which is received from the linear encoder 5 side. In addition, the control unit 9 causes a timing signal (latch signal LAT) which defines generation timing of the driving signal COM which will be described later to be generated based on the encoder pulse.

Figure 3:
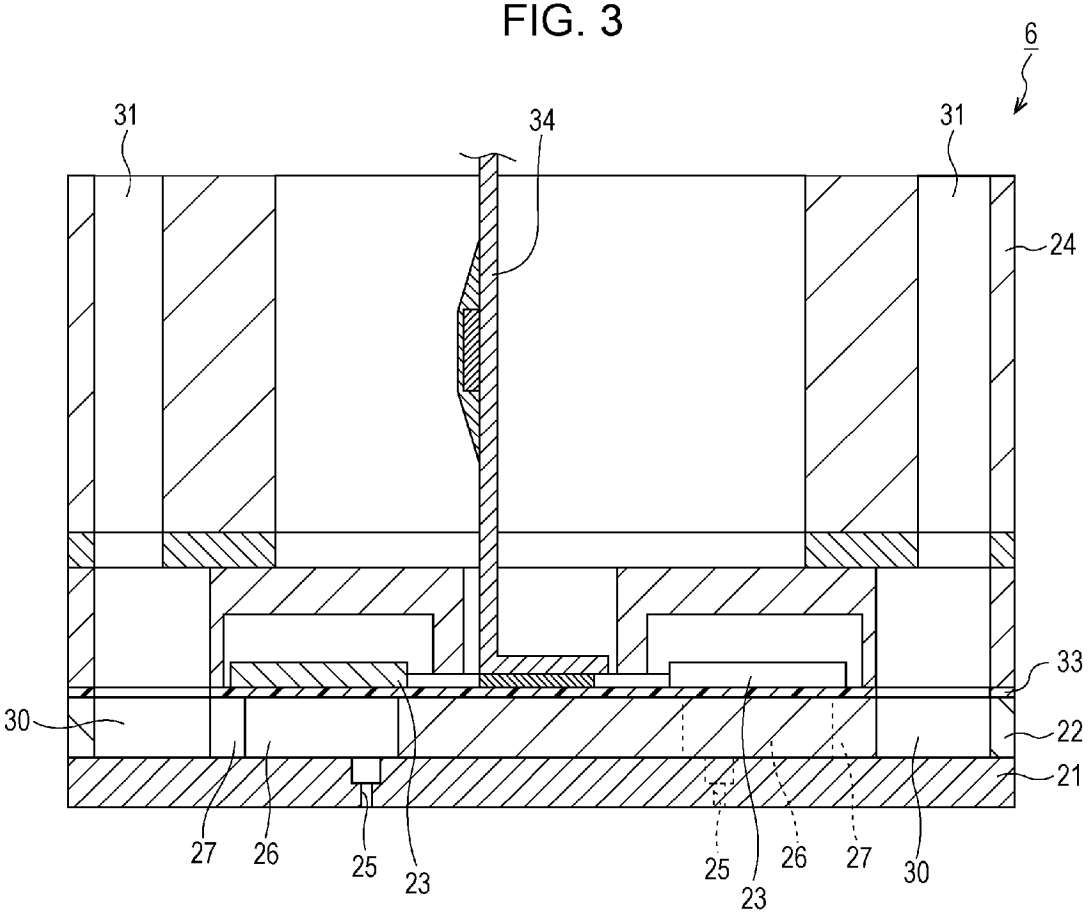
FIG. 3 is a cross-sectional view of a configuration of a recording head.

FIG. 3 is a cross-sectional view of main parts of the recording head 6 which describes an internal configuration.

The recording head 6 according to the embodiment is configured of a nozzle plate 21, a flow path substrate 22, a piezoelectric element 23, and the like, and is attached to a case 24 in a state of laminating these members. The nozzle plate 21 is a plate-shaped member in which a plurality of the nozzles 25 are arranged in a column shape in an open manner at a predetermined pitch. According to the embodiment, two nozzle columns which are configured of the aligned plurality of nozzles 25 are aligned in the nozzle plate 21.

A plurality of the pressurizing chambers 26 are formed on the flow path substrate 22 by being aligned in the nozzle column direction, and a pressurizing chamber column (pressurizing chamber group) is configured by these pressurizing chambers 26. The pressurizing chamber 26 according to the embodiment is a hollow portion which is long in a direction intersecting the aligning direction of the pressurizing chamber. Each pressurizing chamber 26 is provided corresponding to each nozzle 25 of the nozzle plate 21 in one-to-one correspondence. That is, a forming pitch of each pressurizing chamber 26 corresponds to a forming pitch of the nozzle 25. In addition, in the flow path substrate 22, a reservoir 30 (which passes through the flow path substrate 22) is formed along the aligning direction of the pressurizing chamber 26 in each pressurizing chamber group in a region which is outside of a side in the longitudinal direction of the pressurizing chamber (side opposite to communication side with nozzle 25) with respect to the pressurizing chamber 26. The reservoir 30 is a hollow portion which is common to each pressurizing chamber 26 which belongs to the same pressurizing chamber group. The reservoir 30 and each pressurizing chamber 26 respectively communicate with each other through an ink supply port 27. The ink supply port 27 is a portion which is formed so as to have the width smaller than that of the pressurizing chamber 26, and becomes a flow path resistance with respect to ink which flows into the pressurizing chamber 26 from the reservoir 30. In addition, ink from the ink cartridge 17 side is introduced to the reservoir 30 through an ink supply path 31 of the case 24.

The nozzle plate 21 is bonded to the lower face of the flow path substrate 22 (face on opposite side to case 24) through an adhesive, a heat welding film, or the like. The nozzle plate 21 is a plate member on which the plurality of nozzles 25 are arranged in a column shape in an open manner at a predetermined pitch. According to the embodiment, the nozzle column is configured by arranging 360 nozzles 25 in a column at a pitch corresponding to 360 dpi. Each nozzle 25 communicates with the pressurizing chamber 26 at an end portion on the opposite side to the ink supply port 27. In addition, the nozzle plate 21 is formed of glass ceramic, a silicon single crystal substrate, stainless steel, or the like, for example. In the recording head 6 according to the embodiment, two nozzle columns in total are arranged, and liquid flow paths corresponding to each of nozzle columns are horizontally symmetrically arranged by setting the nozzle 25 side to be the inside.

The piezoelectric element 23 is formed on the upper face of the flow path substrate 22 on the opposite side to the nozzle plate 21 side through an elastic film 33. That is, an upper opening of each pressurizing chamber 26 is shut by the elastic film 33, and the piezoelectric element 23 is formed thereon. The piezoelectric element 23 is formed by sequentially laminating a metallic lower electrode film, a piezoelectric layer (piezoelectric film) in which a piezoelectric substance is formed in a thin film shape, and a metallic upper electrode film (none are illustrated). As the piezoelectric layer, it is preferable that crystals be oriented. A piezoelectric layer in which crystals are oriented is formed using, for example, a so-called sol-gel method in which so-called sol in which a metal organic matter is dissolved and dispersed in a catalyst is applied, dried, and gelled, and a piezoelectric layer which is formed of metal oxide is obtained by baking the gelled sol at a high temperature. As a material of the piezoelectric layer, a material of lead zirconate titanate base is preferably used in the ink jet recording head. In addition, a film formation method of the piezoelectric layer is not particularly limited, and the piezoelectric layer may be formed using a sputtering method, for example. In addition, a method in which a precursor film of the lead zirconate titanate is formed using the sol-gel method, the sputtering method, or the like, and is subjected to crystal growth thereafter using a high pressure processing method in alkali aqueous solution may be also used.

In any case, in the piezoelectric layer which is formed in this manner, crystals are preferentially oriented differently from a so-called piezoelectric substance in bulk. In the piezoelectric layer according to the embodiment, crystals are preferentially oriented, and are formed in a columnar shape. In addition, the preferential orientation means a state in which the orientation direction of the crystals is not chaotic, and a specific crystal plane faces an approximately constant direction. In addition, a thin film in which crystals are in a columnar shape means a state in which crystals of approximately cylindrical bodies are collected over a plane direction in a state in which center axes of the crystal approximately match in the thickness direction, and form the thin film. As a matter of course, the thin film may be a thin film which is formed using a granular crystal which is preferentially oriented. In addition, the thickness of the piezoelectric layer (which is manufactured in the thin film process in this manner) is 0.5 μm to 5 μm in general.

Figures 5, 6:
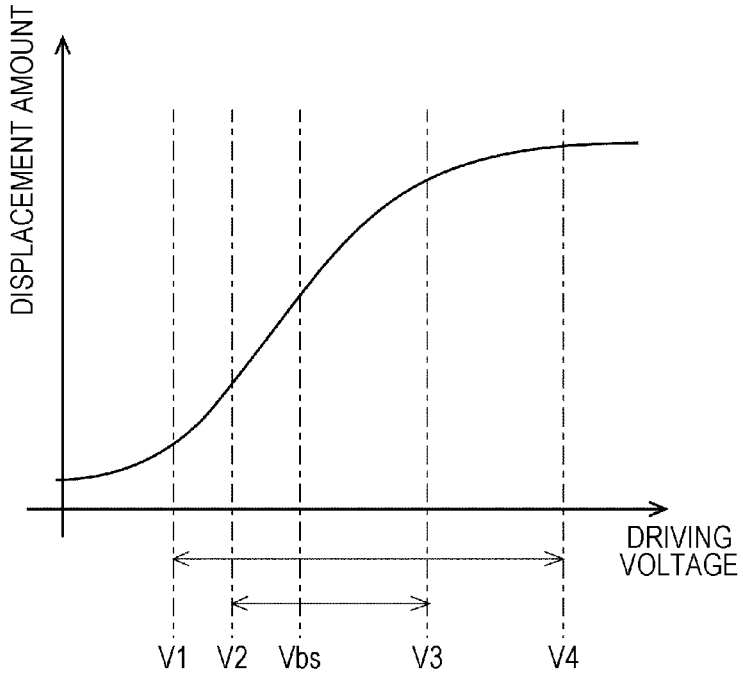
FIG. 5 is a characteristic diagram which illustrates a relationship between a driving voltage and a piezoelectric element displacement.
FIG. 6 is a table that examines a magnitude of a voltage gradient in which ink is not wrongly ejected in a front side changing element or a rear side changing element.

The piezoelectric layer (piezoelectric element 23) which is formed in this manner is deformed when a driving signal COM is applied through a wiring member. Specifically, when a constant common potential is applied to a common electrode, and a vibration waveform is applied to an individual electrode, an electric field corresponding to a potential difference is generated between the electrodes. The piezoelectric layer is bent and deformed according to strength of the electric field. FIG. 5 illustrates an example of a piezoelectric property of the piezoelectric layer (piezoelectric element 23). In addition, a horizontal axis in FIG. 5 is a driving voltage which is applied to the piezoelectric layer (potential difference between upper electrode film and lower electrode film), and a vertical axis is a displacement amount (deformation amount) from the reference position of the piezoelectric layer. As illustrated in FIG. 5, there is a linear region in which a property is changed in approximately a straight line shape in the piezoelectric layer according to the embodiment. Driving voltage regions on both sides (regions of driving voltage on negative side and positive side rather than linear region) of the linear region become a non-linear region in which a ratio of the displacement amount to the driving voltage becomes gradually small.

The piezoelectric layer, that is, the piezoelectric element 23 is bent and deformed according to such a piezoelectric property. That is, the higher the driving voltage (applied voltage), the more a center portion of the piezoelectric element 23 is bent to a side which is close to the nozzle plate 21, and the elastic film 33 is deformed so as to reduce a volume of the pressurizing chamber 26. In contrast, the lower the driving voltage, the more the center portion of the piezoelectric element 23 is bent to a side which is far from the nozzle plate 21, and the elastic film 33 is deformed so as to increase the volume of the pressurizing chamber 26. In this manner, since the volume of the pressurizing chamber 26 is changed when the piezoelectric element 23 is driven, a pressure of ink in the pressurizing chamber 26 is changed along with the change in volume of the pressurizing chamber. In addition, it is possible to eject ink droplets from the nozzle 25 by controlling the pressure change (pressure fluctuation) of the ink.

Subsequently, an electric configuration of the recording head 6 will be described.

As illustrated in FIG. 1, the recording head 6 includes a latch circuit 36, a decoder 37, a switch 38, and the piezoelectric element 23. The latch circuit 36, the decoder 37, and the switch 38 configure a head control unit 15. The head control unit 15 is provided in each piezoelectric element 23, that is, in each nozzle 25. The latch circuit 36 latches ejection data which is based on print data. The ejection data is data which controls ejection or non-ejection of ink from each nozzle. The decoder 37 outputs a switch control signal which controls the switch 38 based on the ejection data which is latched in the latch circuit 36. The switch control signal that is output from the decoder 37 is input to the switch 38. The switch 38 is a switch which is turned on or off according to the switch control signal.

FIGS. 4A and 4B are waveform charts which describe an example of a driving signal which is generated by the driving signal generation unit 11. FIG. 4A denotes the first driving signal COM1, and FIG. 4B denotes a second driving signal COM2. In the embodiment, a unit cycle T (which is a repetition cycle of the driving signals COM1 and COM2) corresponds to a time in which the nozzle 25 moves by a distance corresponding to the width of a pixel which is a constituent element of an image, when the recording head 6 performs ejection of ink while relatively moving with respect to the recording medium S. These driving signals COM1 and COM2 are generated according to the latch signal LAT which is a timing signal generated based on the encoder pulse according to a scanning position of the recording head 6. Accordingly, the driving signals COM1 and COM2 are signals which are generated in a cycle which is defined using the latch signal LAT. In addition, a waveform which is denoted by a solid line in the figure is a potential difference between the individual electrode (upper electrode film) of the piezoelectric element 23 and the common electrode (lower electrode film). In addition, Vbs which is denoted by a dashed line is a DC voltage (bias voltage) which is applied to the common electrode.

The printer 1 according to the embodiment can perform multi-gradation recording in which dots of different sizes are formed on the recording medium S, and according to the embodiment, the printer is configured so that a recording operation of four gradations in total of a large dot, a middle dot, a small dot, and non-ejection (minute vibration) can be performed. In addition, the first driving signal COM1 according to the embodiment is a signal in which three ejection driving pulses of DP1 to DP3 (a type of first driving waveform in the invention) in total are generated in the unit cycle T. In addition, the second driving signal COM2 according to the embodiment is a signal in which three minute vibration driving pulses of VP1 to VP3 (a type of second driving waveform in the invention) in total are generated. In addition, the front side changing element p4 is generated before the minute vibration driving pulse group (second driving waveform group in the invention) which is formed of the set of three minute vibration driving pulses of VP1 to VP3, and the rear side changing element p8 is generated after the minute vibration driving pulse group. In addition, when the recording head 6 moves in a section corresponding to the recording region on the recording medium S in the printing process, at least one of the driving pulses of the driving signals COM1 and COM2 is selectively applied to the piezoelectric element 23 which is provided in each pressurizing chamber 26. Specifically, when the recording head 6 moves in a section corresponding to the above described recording region, any one of the first driving signals COM1, or the plurality of driving pulses are selected and applied to the piezoelectric element 23 corresponding to the nozzle 25 in which ink is ejected in a predetermined cycle. Meanwhile, each of the minute vibration driving pulses VP1 to VP3 of the second driving signal COM2 is sequentially applied to the piezoelectric element 23 corresponding to the nozzle 25 in which ink is not ejected in a predetermined cycle in the section corresponding to the recording region.

The ejection driving pulses DP1 to DP3 are driving pulses in which a waveform or a voltage for ejecting ink from the nozzle 25 is determined. Specifically, as illustrated in FIG. 4A, the ejection driving pulses DP1 to DP3 are so-called trapezoidal waves which are configured of the first expansion element p1, a first expansion maintaining element p2, and the first contraction element p3. The first expansion element p1 is an element which causes the pressurizing chamber 26 to expand from a standard volume by being changed from a reference potential V4 which is a reference of a change in potential to a first potential V1 (lowest potential) which is lower than the reference potential V4. The first potential V1 according to the embodiment is set to a potential which is lower than the bias potential Vbs which is a reference of the generated driving signals COM1 and COM2, or a driving signal other than those. The first expansion maintaining element p2 is an element which maintains the pressurizing chamber 26 which is expanded by maintaining the first potential V1 for a certain time. The first contraction element p3 is an element which contracts the pressurizing chamber 26 which is expanded by being changed from the first potential V1 to the reference potential V4. When one of such ejection driving pulses of DP1 to DP3 is applied to the piezoelectric element 23, ink droplets corresponding to a small dot are ejected from the nozzle 25. Specifically, when the first expansion element p1 is applied first, a meniscus which is exposed to the nozzle 25 is drawn into the pressurizing chamber 26 side. This state is maintained by the first expansion maintaining element p2. When the first contraction element p3 is applied thereafter, the pressurizing chamber 26 is rapidly contracted, and ink in the pressurizing chamber 26 is pressurized. In this manner, ink droplets are ejected from the nozzle 25.

In addition, the reference volume is a volume which becomes a starting point of expansion or contraction of the pressurizing chamber 26 (initial volume), and is a volume when the reference potential V4 is applied to the piezoelectric element 23. The reference potential V4 according to the embodiment is set to a potential which is sufficiently higher than a ground potential GND and the bias potential Vbs, and for example, the reference potential is a potential corresponding to a state in which the piezoelectric element 23 is bent to the maximum to the inside of the pressurizing chamber 26 (that is, side which is close to nozzle 25), or to an extent of being close to the maximum. That is, the reference potential V4 is set to a non-linear region in which a displacement amount of the piezoelectric element 23 becomes the maximum, or to an extent of being close to the maximum in the piezoelectric property which is illustrated in FIG. 5. In contrast, the first potential V1 is set to a potential which is lower than a potential corresponding to a lower end side (low voltage side) of the linear region, in order to use the linear region in which a ratio of the displacement amount to the driving voltage is large to the maximum. In this manner, it is possible to make the displacement amount of the piezoelectric element 23 large, and to eject UV ink with high viscosity with high precision. According to the embodiment, the first potential V1 is set to a potential corresponding to the vicinity of a boundary between the lower end of the linear region and the non-linear region. In addition, the bias potential Vbs according to the embodiment is set to a potential corresponding to the middle of the linear region. In addition, the waveform of the ejection driving pulse, the number of pulses generated around the unit cycle T, or the like is not limited to examples in the embodiment, and it is possible to adopt various configurations.

As illustrated in FIG. 4B, the front side changing element p4 which is included in the second driving signal COM2 is a potential which is changed from the reference potential V4 to the second potential V2 which becomes a reference of a potential change of the minute vibration driving pulses VP1 to VP3. The second potential V2 according to the embodiment is a potential which is lower than the reference potential V4 and the bias potential Vbs, and a potential which is higher than the first potential V1, and is set to a potential corresponding to the lower end side of the linear region in the piezoelectric property illustrated in FIG. 5. In addition, as illustrated in FIG. 4B, the rear side changing element p8 is a potential which is changed from the second potential V2 to the reference potential V4. That is, the potential is changed from the reference potential V4 which is a reference of a potential change in the ejection driving pulses DP1 to DP3 to the second potential V2 which is a reference of a potential change in the minute vibration driving pulses VP1 to VP3 by the front side changing element p4 before the minute vibration driving pulses VP1 to VP3, and is returned to reference potential V4 from the second potential V2 by the rear side changing element p8 after the minute vibration driving pulses VP1 to VP3.

In addition, it is preferable that the front side changing element p4 and the rear side changing element p8 satisfy the following expression (1) when a magnitude of a voltage slope of the front side changing element p4 or the rear side changing element p8 (absolute value of change amount of voltage per unit time) is set to A, so that ink is not wrongly ejected when the pressurizing chamber suddenly expands or contracts.

$$2.8 \leq A \leq 3.3 \quad (1)$$

FIG. 6 is a table in which a magnitude of a voltage slope in which ink is not wrongly ejected in the front side changing element p4 or the rear side changing element p8 is examined. In the table, a voltage (V) is a change amount of a voltage of the changing elements p4 and p8, and a time (μs) is a time width of the changing elements p4 and p8. In addition, a slope (V/μs) is a voltage slope of the changing elements p4 and p8. As is understood from the table, ink is not ejected when a magnitude of a voltage slope is from 2.9 V/μs to 3.2 V/μs, regardless of the magnitude of the voltage. For this reason, it is preferable that the magnitude of a voltage slope of the front side changing element p4 or the rear side changing element p8 be at least within this range.

The minute vibration driving pulses VP1 to VP3 are driving pulses which are set to a waveform which can vibrate (minutely vibrate) a meniscus to an extent of not ejecting ink from the nozzle 25, in order to suppress thickening of ink in a nozzle 25 in the middle of recording operation, or in a standby mode. The minute vibration driving pulses VP1 to VP3 are set to a trapezoidal wave which is changed to a high potential side based on the second potential V2. Specifically, as illustrated in FIG. 4B, the minute vibration driving pulses VP1 to VP3 are configured of a second contraction element p5, a second contraction maintaining element p6, and a second expansion element p7. The second contraction element p5 is an element which is changed from the second potential V2 to a third potential V3 which is higher than the second potential V2 and the first potential V1, and is lower than the reference potential V4, and contracts the pressurizing chamber 26 so as to be relatively small. The third potential V3 according to the embodiment is a potential which is higher than the bias potential Vbs, and is set to a potential corresponding to the vicinity of a boundary between the upper end of the linear region (high voltage side) and the non-linear region in the piezoelectric property which is illustrated in FIG. 5. The second contraction maintaining element p6 is an element which maintains the pressurizing chamber 26 which is contracted using the second contraction element p5 for a certain time by maintaining the third potential V3. The second expansion element p7 is an element which is changed from the third potential V3 to the second potential V2, and causes the contracted pressurizing chamber 26 to be expanded. When such minute vibration driving pulses VP1 to VP3 are applied to the piezoelectric element 23, the volume of the pressurizing chamber 26 fluctuates so as to be small compared to the case in which the ejection driving pulses DP1 to DP3 are applied. In addition, when the minute vibration driving pulses VP1 to VP3 are sequentially applied, that is, when the second contraction element p5 and the second expansion element p7 are repeatedly applied, the meniscus minutely vibrates.

In addition, it is preferable that the second contraction element p5 and the second expansion element p7 satisfy the following expression (2), when a magnitude of a voltage slope of the second contraction element p5 or the second expansion element p7 (absolute value of change amount of voltage per unit time) is set to B.

$$A \leq 2B \quad (2)$$

In this manner, since voltages of the minute vibration driving pulses VP1 to VP3 are changed between the second potential V2 which is lower than the reference potential V4 and the third potential V3 which is higher than the first potential V1 and the second potential V2, and is lower than the reference potential V4, and it is possible to drive the piezoelectric element 23 in a region in which a displacement amount (deformation amount) of the piezoelectric element 23 (piezoelectric substance) in the piezoelectric property is large (linear region) (refer to FIG. 5). In this manner, it is possible to increase a heat amount using the piezoelectric element 23 when minutely vibrating UV ink in the pressurizing chamber 26 corresponding to a nozzle 25 from which the UV ink is not ejected. As a result, it is possible to reduce a temperature difference of UV ink between a nozzle 25 from which UV ink is ejected and a nozzle 25 from which UV ink is not ejected, and to suppress a variation in the ejection property of UV ink between nozzles 25. In addition, since it is possible to increase the heat amount using the piezoelectric element 23 in the maintenance operation (minute vibration operation which causes UV ink in pressurizing chamber 26 to be minutely vibrated) which is performed between the printing operations, it is possible to increase an effect of suppressing thickening of UV ink. As a result, it is possible to shorten a maintenance operation time. In particular, since a ratio of viscosity of the photocurable liquid such as UV ink, or the like, (which is changed due to a temperature change) is large compared to normal ink, even though the photocurable liquid is hardly thickened due to volatilization, decreasing in viscosity due to heat of the piezoelectric element 23 becomes remarkable compared to increasing in viscosity due to shortening of the maintenance operation time. As a result, it is possible to make a time for the minute vibration operation in the printer 1 using UV ink shorter.

Figure 7A:
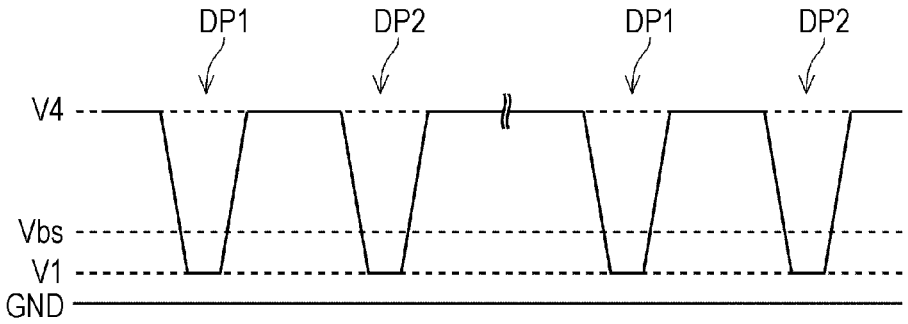
FIG. 7A is a waveform chart when an ejection driving pulse is continuously applied to a piezoelectric element.
Figure 7B:
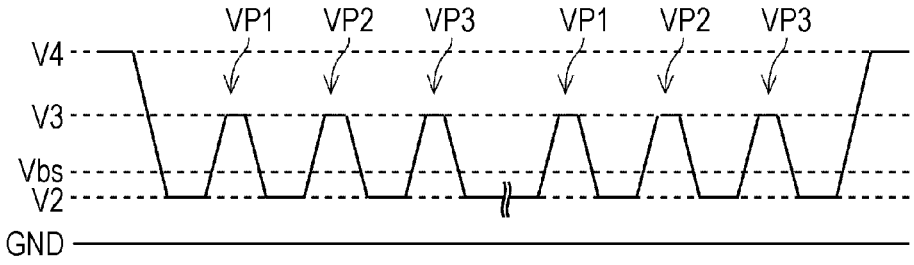
FIG. 7B is a waveform chart when a minute vibration driving pulse is continuously applied to the piezoelectric element.
Figure 8A:
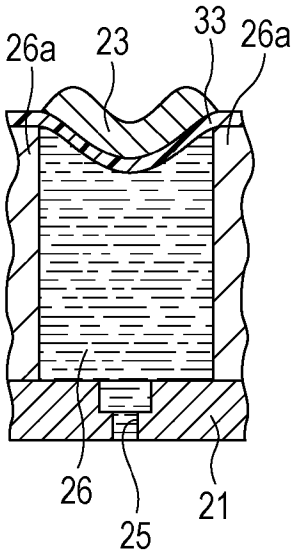
FIGS. 8A to 8C are schematic diagrams which describe an operation of the piezoelectric element.
Figure 8B:
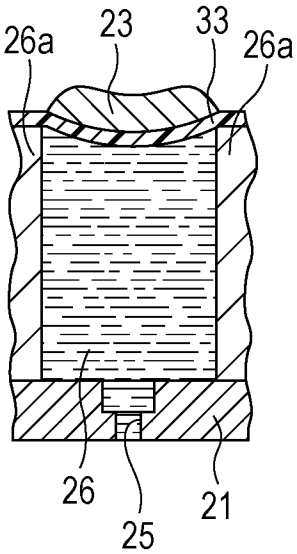
Figure 8C:
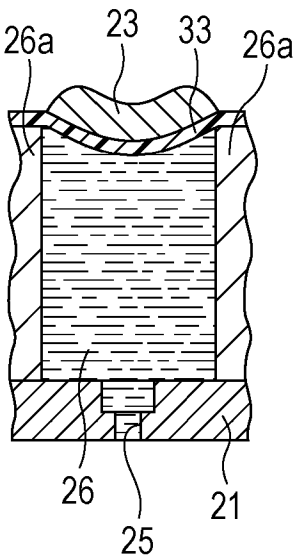

In addition, the minute vibration driving pulses VP1 to VP3 drive the piezoelectric element 23 between the second potential V2 and the third potential V3 which are lower than the reference potential V4, and it is possible to suppress a change in ejection property, so-called crosstalk, which is caused by bending of a partitioning wall 26*a* which partitions the pressurizing chambers 26. This point will be described with reference to FIGS. 7A to 8C. FIG. 7A is a waveform chart when the ejection driving pulse is continuously applied to the piezoelectric element 23, and FIG. 7B is a waveform chart when the minute vibration driving pulse is continuously applied to the piezoelectric element 23. In addition, FIGS. 8A to 8C are cross-sectional schematic diagrams of the pressurizing chamber 26 in the short direction (arranging direction of pressurizing chamber), in which FIG. 8A illustrates a state of the piezoelectric element 23 to which the reference potential V4 is applied, FIG. 8B illustrates a state of the piezoelectric element 23 to which the second potential V2 is applied, and FIG. 8C illustrates a state of the piezoelectric element 23 to which the third potential V3 is applied, respectively.

As illustrated in FIG. 7A, for example, when the ejection driving pulses DP1 and DP2 among the ejection driving pulses DP1 to DP3 are continuously applied, the piezoelectric element 23 is in a state in which the reference potential V4 is primarily applied. For this reason, as illustrated in FIG. 8A, in the piezoelectric element 23, a state of being displaced to the maximum to the lower side (pressurizing chamber 26 side) becomes relatively large. Due to the displaced piezoelectric element 23, a tension of pulling the partitioning wall 26*a* which partitions the pressurizing chamber 26 inside is generated, and the partitioning wall 26*a* becomes easy to bend. On the other hand, as illustrated in FIG. 7B, when the minute vibration driving pulses VP1 to VP3 are continuously applied, the piezoelectric element 23 is in a state in which the second potential V2 and the third potential V3 which are lower than the reference potential V4 are applied. For this reason, as illustrated in FIGS. 8B and 8C, displacement of the piezoelectric element 23 becomes small compared to a case in which the reference potential V4 is applied. For this reason, the tension of the piezoelectric element 23 which pulls the partitioning wall 26*a* inside becomes small, and it is possible to suppress bending of the partitioning wall 26*a*. As a result, it is possible to suppress a change in ejection property of ink which is caused by bending of the partitioning wall 26*a*, that is, so-called crosstalk. In brief, by adopting the configuration of the invention, it is possible to obtain an effect of suppressing crosstalk, since the heat amount increases, and in addition, a tension is not generated in the partitioning wall 26*a* due to shifting of the potential pertaining to the piezoelectric element 23 to a low potential.

In addition, forms of the minute vibration driving pulses VP1 to VP3 are not limited to the above described embodiment, and can be arbitrarily set according to the piezoelectric property, or the like, of the piezoelectric element 23. For example, according to the embodiment, the second potential V2 (which is a reference of the minute vibration driving pulses VP1 to VP3) is set to be lower than the reference potential V4; however, the second potential may be set to be higher than the reference potential V4 without being limited to this. In brief, the second potential which is the reference of the minute vibration driving pulse may be set to a potential which is different from the reference potential according to the piezoelectric property of the piezoelectric element. In addition, according to the embodiment, the minute vibration driving pulses VP1 to VP3 are set to a trapezoidal wave which is changed to the high potential side based on the reference of the second potential V2; however, there is no limitation to this, and it is also possible to set the minute vibration driving pulse to a trapezoidal wave which is changed to the low potential side. In addition, according to the embodiment, three minute vibration driving pulses VP1 to VP3 are provided in the unit cycle T; however, there is no limitation to this, and the number of minute vibration driving pulses which is included in the unit cycle T can be arbitrarily changed.

In addition, according to the embodiment, the piezoelectric element 23 which is a so-called bending-vibrating type is exemplified as a piezoelectric element; however, there is no limitation to this, and for example, it is also possible to adopt a piezoelectric element which is a so-called longitudinal vibration type. In addition, when being a pressure generator which causes a pressure fluctuation in liquid in a pressurizing chamber and has a hysteresis property, it is also possible to adopt a heat generating element, an electrostatic actuator, or the like, for example, without being limited to the piezoelectric element.

In addition, when it is a liquid ejecting apparatus which performs a vibration control of liquid by driving a piezoelectric element, by applying a maintenance driving waveform, the invention can also be applied to various ink jet recording apparatuses such as a plotter, a facsimile machine, and a copy machine, without being limited to a printer.

What is claimed is:

1. A liquid ejecting apparatus comprising:

a liquid ejecting head which causes a pressure fluctuation in liquid in a pressurizing chamber by driving a pressure generator, and ejects the liquid from a nozzle which communicates with the pressurizing chamber using the pressure fluctuation, wherein it is possible to generate a first driving waveform in which liquid is ejected from the nozzle by driving the pressure generator, and a plurality of second driving waveforms which cause a pressure fluctuation in liquid in the pressurizing chamber to an extent of not causing the liquid to be ejected from the nozzle, wherein the first driving waveform includes a first expansion element which causes the pressurizing chamber to be expanded by being changed from a reference potential which is a reference of a change in potential to a first potential which is lower than the reference potential, and a first contraction element which causes the pressurizing chamber to be contracted by being changed from the first potential to the reference potential, and wherein the second driving waveform includes a second contraction element which causes the pressurizing chamber to be contracted by being changed from a second potential which is lower than the reference potential to a third potential which is higher than the second potential and the first potential, and is lower than the reference potential, and a second expansion element which causes the pressurizing chamber to be expanded by being changed from the third potential to the second potential, wherein a second driving waveform group which is formed of a plurality of sets of the second driving waveforms is generated, and wherein a front side changing element which causes a change from the reference potential to the second potential is generated before the second driving waveform group.

2. The liquid ejecting apparatus according to claim 1, wherein a rear side changing element which causes a change from the second potential to the reference potential is generated after the second driving waveform group.

3. The liquid ejecting apparatus according to claim 1, wherein the liquid is photocurable liquid which is cured when being irradiated with light.

4. A method for ejecting liquid from a nozzle, the method comprising:

an act of driving a pressure generator in a liquid ejecting head thereby causing a pressure fluctuation in liquid in a pressurizing chamber which communicates with the nozzle using the pressure fluctuation, the act of driving the pressure generator comprising:

an act of generating a first driving waveform in which liquid is ejected from the nozzle by driving the pressure generator an act of generating a plurality of second driving waveforms which cause a pressure fluctuation in liquid in the pressurizing chamber to an extent of not causing the liquid to be ejected from the nozzle, wherein the first driving waveform includes a first expansion element which causes the pressurizing chamber to be expanded by being changed from a reference potential which is a reference of a change in potential to a first potential which is lower than the reference potential, and a first contraction element which causes the pressurizing chamber to be contracted by being changed from the first potential to the reference potential, and wherein the second driving waveform includes a second contraction element which causes the pressurizing chamber to be contracted by being changed from a second potential which is lower than the reference potential to a third potential which is higher than the second potential and the first potential, and is lower than the reference potential, and a second expansion element which causes the pressurizing chamber to be expanded by being changed from the third potential to the second potential, wherein a second driving waveform group which is formed of a plurality of sets of the second driving waveforms is generated, and wherein a front side changing element which causes a change from the reference potential to the second potential is generated before the second driving waveform group.

* * * * *